US005669169A

United States Patent [19]

Schmitter et al.

[11] Patent Number: 5,669,169

[45] Date of Patent: Sep. 23, 1997

[54] HANDGUN HAVING METALLIC RAILS WITHIN A POLYMERIC FRAME

[75] Inventors: Edward P. Schmitter, Blythewood; Harold L. Miller, Lugoff, both of S.C.; Milton W. Erickson, Merrillan; Gerald A. Thoe, Cippewa Falls, both of Wis.

[73] Assignee: FN Manufacturing, Inc., Columbia, S.C.

[21] Appl. No.: 632,949

[22] Filed: Apr. 16, 1996

[51] Int. Cl.[6] ..... F41C 23/00

[52] U.S. Cl. ..... 42/75.01; 42/71.02; 89/196

[58] Field of Search ..... 42/71.01, 71.02, 42/100, 103, 72, 16, 75.01, 75.03; 89/37.04, 194, 195, 196, 197; 124/83

[56] References Cited

U.S. PATENT DOCUMENTS

| | | | |
|---|---|---|---|
| 747,585 | 12/1903 | Browning | 89/196 |
| 3,110,223 | 11/1963 | Schlappich | 89/196 |
| 3,411,407 | 11/1968 | Pachmayr et al. | 89/196 |
| 3,611,608 | 10/1971 | Seiberling | 42/17 |
| 3,728,939 | 4/1973 | Wilhelm | 89/196 |
| 3,956,967 | 5/1976 | Martz | 89/175 |
| 4,290,220 | 9/1981 | Ruger | 45/75 D |
| 4,463,655 | 8/1984 | Krieger | 89/196 |
| 4,539,889 | 9/1985 | Glock | 89/147 |
| 4,594,935 | 6/1986 | Smith | 89/176 |
| 4,602,450 | 7/1986 | Hoenig | 42/75.02 |
| 4,703,826 | 11/1987 | Byron | 89/188 |
| 4,709,497 | 12/1987 | Resca | 42/75.02 |
| 4,825,744 | 5/1989 | Glock | 89/145 |
| 4,893,546 | 1/1990 | Glock | 89/145 |
| 5,179,233 | 1/1993 | du Plessis | 42/69.02 |
| 5,272,957 | 12/1993 | Chesnut et al. | 89/195 |
| 5,293,708 | 3/1994 | Stryer et al. | 42/75.03 |
| 5,343,650 | 9/1994 | Swan | 42/100 |
| 5,406,731 | 4/1995 | Stevens | 42/71.02 |
| 5,586,545 | 12/1996 | McCaslin | 124/73 |

*Primary Examiner*—Charles T. Jordan
*Assistant Examiner*—Meena Chelliah
*Attorney, Agent, or Firm*—Michael A. Mann

[57] ABSTRACT

The present invention is a handgun having a polymeric frame with metallic rails that are inserted within the frame after the frame has been formed by a molding process. The rails are inserted into recesses formed in a channel within the frame, before the frame has completely cooled and contracted. The rails comprise a pair of front rails and a pair of rear rails. The rear pair of rails are positioned within rear recesses and held in place by the sear block. The front pair of rails are positioned within front recesses and held in place by a plurality of metallic parts. The parts include a horseshoe, an unlock block, and a spreader block that are positioned between and matingly engage the front rails, thus securing them within their respective recesses.

23 Claims, 2 Drawing Sheets

2
2
12
24
26
124
122
122
120
126
132
134
130
136
80
10
94
90
92
70
70
80
94
102
100
142
146
140
144
30
40
36
32
42
50
38
50
34
18
80
104
104
70
70

80
30
20
130
72
146
74
142
140
144

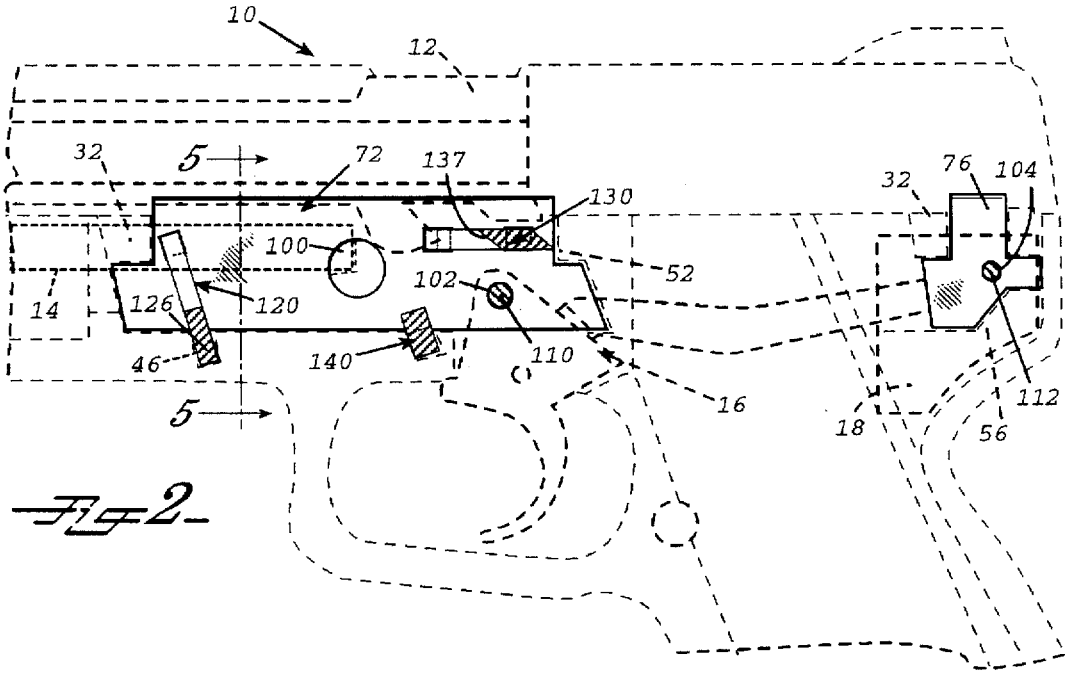
Fig-2
Fig-3
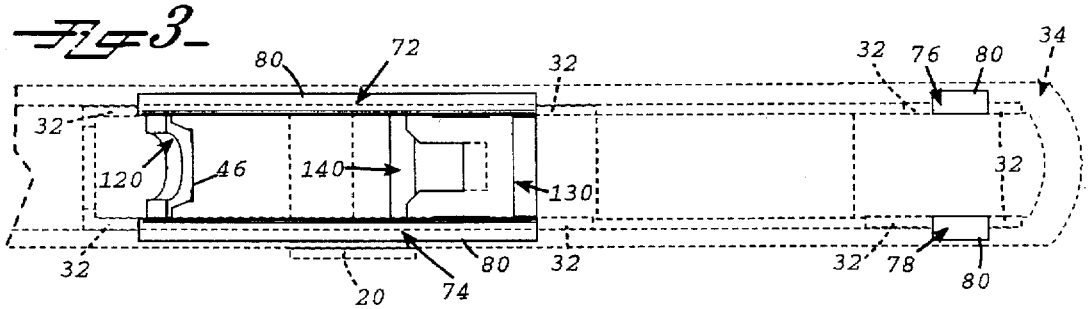
Fig-4
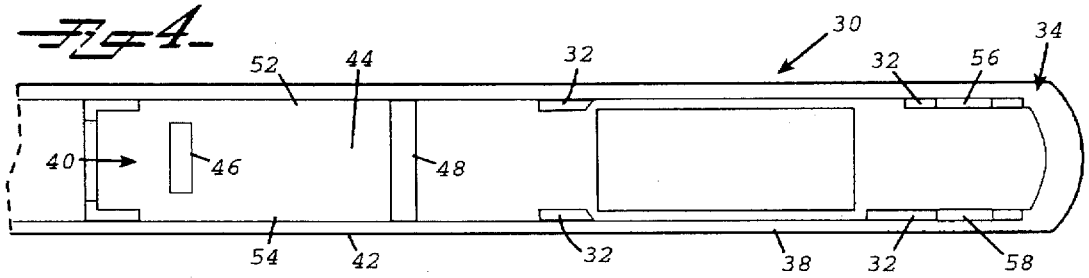

HANDGUN HAVING METALLIC RAILS WITHIN A POLYMERIC FRAME

BACKGROUND OF THE INVENTION

1. Field of the Invention

The present invention relates to firearms. In particular, the present invention relates to the installation of metallic front and rear rails into a polymeric handgun.

2. Discussion of Background

Semiautomatic handguns have been manufactured and used for decades. Improvements in semiautomatic handguns have increased their sophistication and effectiveness. Generally, these handguns are preferred by military and law enforcement personnel in the line of duty where a handgun must be accurate, reliable and safe to use. A handgun must be able to hit the target it is aimed at, to fire rounds repeatedly without jamming, and to fire only when the user intends to fire the handgun. Beyond these three basic concerns, a handgun should also be durable, have good balance, be easy to operate and service, be simple and inexpensive to manufacture, and have consistent, reasonable trigger-pull characteristics.

A semiautomatic handgun captures and utilizes part of the energy released from the firing of one round to load the next round into the firing chamber. Usually, the energy taken up by the recoil of a slide is used to push the next of a series of rounds into the firing chamber. The slide is part of one of a handgun's component groups that includes the barrel and breech block. In addition to the slide, a semiautomatic handgun has other component groups. There is the frame that includes the handle and trigger guard. The handle may be hollow in order to receive a clip containing a number of rounds of ammunition. The rounds are fed one at a time into the breech block. Finally, there is the fire control system which includes the trigger, the trigger bar, the sear, the striker, and the striker spring.

Semiautomatic handguns that are constructed from cast or machined metal or polymers typically have an integral frame structure which incorporates rails that are designed to receive the reciprocating slide. In this type of construction, the rails are generally designed so that they are integral with the frame and constructed from the same material.

However, in handguns that are constructed from a combination of materials, such as metallic and polymeric materials, it is inherently impossible for the polymer and metal structures to be formed integrally. Consequently, different manufacturing techniques have been devised in order to combine two or more materials into a single handgun. One such example is handguns with the frame constructed from a polymer and the rails constructed from a metal. In the past, the metal rails have been incorporated into the polymer during the molding process of the polymer.

This manufacturing process, however, has significant disadvantages. First, the process of incorporating a structure of different material properties into a polymer mold is both difficult and expensive. Second, because the metal rails are incorporated into the structure of the polymer, sometimes the exterior of the handgun appears to be warped or distorted. The warping of the exterior of the polymer is generally caused by the difference in thermal coefficients of expansion between the metal and polymer, so that as the polymer frame contracts around the metal rails, the rails cause the polymer to bulge in certain areas. This warping not only hinders the aesthetic appearance of the exterior of the handgun, but more importantly, imparts internal stresses into the polymer construction of the frame, thus providing less than optimum characteristics for the handgun.

Consequently, there is a need for a new handgun frame and method of assembling the frame that enables the combination and cooperation of polymeric and metallic materials into its construction. More, specifically, there is a need for a handgun frame and method for assembling the same where the handgun has a polymeric frame with metallic rails that enable a metallic reciprocating slide to be slidably mounted thereon.

SUMMARY OF THE INVENTION

According to its major aspects and broadly stated, the present invention is a handgun having a polymeric frame with metallic rails that are inserted into the polymeric frame after the molding process, not during the molding process. The handgun comprises a frame that is constructed from a polymeric material and a slide and rails that are both constructed from a metallic material. The handgun has other components that are necessary for its operation, but those of ordinary skill in the art will recognize the placement and operation of those other components.

The frame of the handgun includes the trigger guard and handle. Additionally, the frame has a channel formed therein, where typically, the barrel and spring mechanism rest. The channel has a base and sides, with two grooves formed in the base and front and rear recesses formed in the sides.

The rails of the present invention function much the same as in other handguns, providing structure for the slide to ride on. However, in the present invention, the rails are constructed from metal and inserted into the polymeric frame after the frame has been molded. The rails comprise a pair of front rails and a pair of rear rails. The front rails are symmetric with each other, but the rear rails differ according to which side of the handgun they are placed on.

The front rails are secured within the front recesses of the channel by a plurality of metallic parts. The front rails each have three notches that are positioned proximate to the top of the channel once the front rails are in position within the recesses. The metallic parts comprise a horseshoe, an unlock block, and a spreader block. The horseshoe has a pair of tabs, and the unlock block has two pair of tabs that matingly engage the respective notches of the front rails and secure them into position within the recesses of the channel. Additionally, the horseshoe engages one of the grooves within the base of the channel, thus further securing it in place. The spreader block is insertable into the other groove within the base of the channel, so that it sits beneath the front rails and extends under the recesses. The spreader block holds the front rails apart and secures them within the recesses from the base of the rails.

The rear rails are secured in the rear recesses in the sides of the channel by the sear block of the handgun. Both the front rails and rear rails extend above the top of the channel, thus providing a front and rear set of tongues in which the slide engages grooves within. Furthermore, both the front and rear rails have several holes that extend through the width of the handgun. These holes correspond to the take down lever, trigger pin and sear block pin.

During the manufacturing and assembly process of the handgun, the frame is molded from a polymeric material. While the frame is still warm, that is, before it has fully contracted, the spreader block is inserted within its groove and the metal rails are inserted within the recesses in the channel. The other metallic parts, including the horseshoe and unlock block, are then secured between the front rails. Additionally, the rear rails are positioned and the sear block placed into position. Consequently, as the frame continues to contract, the frame snugly secures the front rails and rear rails into position.

A major feature of the present invention is the cooperation of the metal rails and other metallic parts with the polymeric frame and sear block. This cooperation enables the handgun to be easily manufactured and assembled without the past problems of expense, bulging sides, and internal stresses. Consequently, the cooperation of the polymeric and metallic parts provides an aesthetically pleasing and soundly manufactured handgun.

Another feature of the present invention is the metallic inserts that hold the front rails into position within the front recesses in the sides of the channel. The metallic inserts, including the horseshoe, the unlock block, and the spreader block, engage the notches formed within the front rails and the grooves within the base of the channel to securely hold the front rails within the frame.

Still another feature of the present invention is the cooperation of the sear block with the rear rails. The sear block, a necessary component of the handgun's fire control system, not only functions in its usual way, but also performs a second function of securely holding the rear rails within the rear recesses in the sides of the channel.

Other features and advantages of the present invention will be apparent to those skilled in the art from a careful reading of the Detailed Description of a Preferred Embodiment presented below and accompanied by the drawings.

BRIEF DESCRIPTION OF THE DRAWINGS

In the drawings,

FIG. 2 is a cross-sectional view of the handgun taken along line 2—2 of FIG. 1 according to a preferred embodiment of the present invention;

FIG. 3 is a top view of a handgun with the slide removed according to a preferred embodiment of the present invention;

FIG. 4 is a top view of a handgun with the slide, rails, and metallic parts removed for clarity, according to a preferred embodiment of the present invention.

DETAILED DESCRIPTION OF A PREFERRED EMBODIMENT

Figure 1:
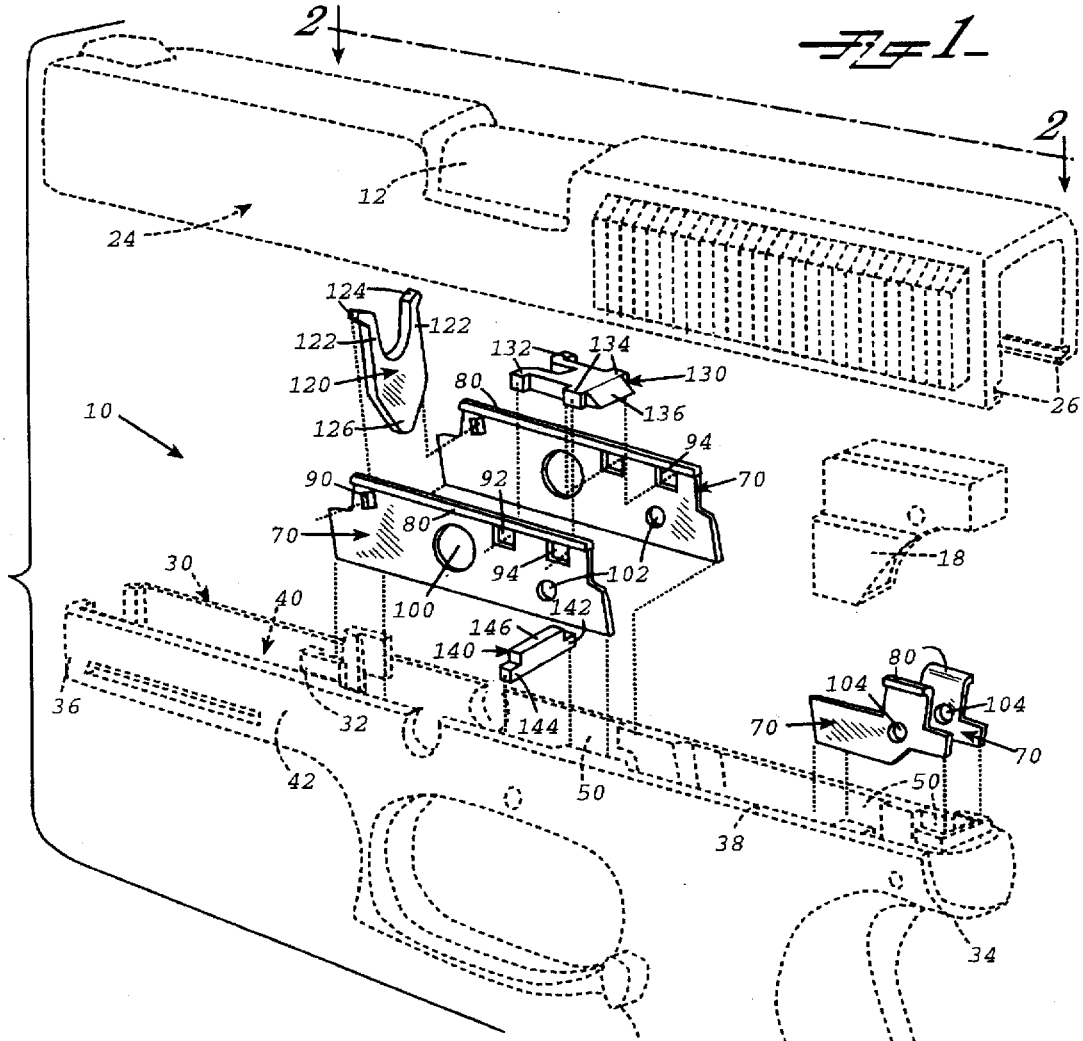
FIG. 1 is an exploded view of a handgun with the frame and slide shown in dashed lines for clarity, according to a preferred embodiment of the present invention.
Figure 5:
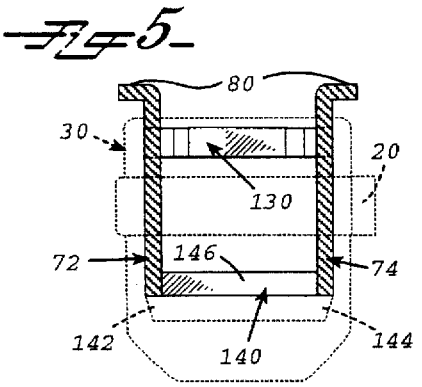
FIG. 5 is a cross-sectional view of the handgun taken along line 5—5 of FIG. 2 according to a preferred embodiment of the present invention.

Referring now to the figures, a drop barrel type handgun 10 that is constructed from a combination of materials is shown. Handgun 10 comprises a frame 30, a slide 24, and rails 70. Handgun 10 also comprises a barrel 12, spring mechanism 14, trigger assembly 16, sear block 18, and take down lever 20; however, those of ordinary skill in the art will recognize the functions and operations of these elements of the present invention.

Frame 30 is formed from a polymeric material by any process known in the art, but in the preferred embodiment is formed by a molding process. Additionally, frame 30 has a channel 40 that extends from the back end 34 to the front end 36 of handgun 10; front end 36 is proximate to where a fired round would exit barrel 12. Furthermore, there are a plurality of protrusions 32 that extend into channel 40. While all protrusions 32 provide additional structural integrity to frame 30, some have additional functions which will be described in detail below.

Rails 70 are formed from a metallic material, which in the preferred embodiment is 410 stainless steel and are positioned within channel 40 of frame 30. Rails 70 also comprise a right front rail 72, a left front rail 74, a right rear rail 76, and a left rear rail 78. While right front rail 72 and left front rail 74 are symmetric with respect to each other, left rear rail 78 is not symmetric with respect to right rear rail 76. However, each of rails 70 has a tongue 80 that extends above the top 38 of frame 30 when rails 70 are in position within channel 40. Tongue 80 of rails 70 corresponds to grooves 26 that extend within slide 24, which in the preferred embodiment is formed from 416 stainless steel. Thus, the tongue and groove combination of rails 70 and slide 24 enable slide 24 to travel back and forth along rails 70.

Channel 40 within frame 30 also has sides 42 and a base 44. Within sides 42 are formed a plurality of recesses 50, which comprise a right front recess 52, a left front recess 54, a right rear recess 56, and a left rear recess 58. Each of recesses 50 is defined within frame 30 by protrusions 32 and is designed to receives rails 70 so that each of rails 70 fits within each of recesses 50, respectively. Base 44 of channel 40 has a first groove 46 and second groove 48 within frame 30. It is not necessary for first groove 46 to extend all the way across channel 40, but second groove 48 should extend across channel 40.

Right front rail 72 and left front rail 74 have a first notch 90 formed therein, where first notch 90 is basically a square hole positioned at an angle and extending through rails 70. Also extending through right front rail 72 and left front rail 74 are a second notch 92 and third notch 94. Second notch 92 and third notch 94 are similar in construction and are positioned towards back end 34 of frame 30 when right front rail 72 and left front rail 74 are in position. Additionally, right front rail 72 and left front rail 74 have a large hole 100 and a small hole 102 that extend therethrough. Large hole 100 is adapted to permit takedown lever 20 to extend through frame 30 and right front rail 72 and left front rail 74. Small hole 102 is adapted to receive a pin 110 that extends through frame 30, left front rail 74 and right front rail 72, so that trigger assembly 16 may be pivotally mounted thereon.

Right front rail 72 and left front rail 74 are basically in the form of a plate, with tongue 80 extending approximately 90° therefrom. As stated above, tongue 80 is dimensioned to be received by grooves 26 of slide 24. Furthermore, right front rail 72 and left front rail 74 are designed to be inserted within right front recess 52 and left front recess 54, respectively.

Right front rail 72 and left front rail 74 are secured in place within right front recess 52 and left front recess 54, respectively, by a series of metallic parts. These parts include a horseshoe 120, an unlock block 130, and a spreader block 140. Horseshoe 120 has a U-shape defined by a pair of arms 122. At the ends of each arm 122 is a tab 124 that is dimensioned to fit within first notch 90 of right front rail 72 and left front rail 74. Furthermore, the bottom end 126 of horseshoe 120 is designed to be received by first groove 46 within base 44 of channel 40. Thus, when right front rail 72 and left front rail 74 are in position within their respective recesses 50, tabs 124 of horseshoe 120 matingly engage first notches 90, and bottom end 126 of horseshoe 120 matingly engages first groove 46 of channel 40. In the preferred embodiment, horseshoe 120 is positioned within channel 40 at an angle having bottom end 126 closer to back end 34 of frame 30. Additionally, the opening defined by arms 122 is designed to provide clearance for spring mechanism 14 therebetween.

Unlock block 130 has a first pair of tabs 132 and a second pair of tabs 134 that in the preferred embodiment are dimensioned similar to tabs 124 of horseshoe 120. First pair of tabs 132 and second pair of tabs 134 are designed to be received by second notches 92 and third notches 94 of right front rail 72 and left front rail 74, respectively. Unlock block 130 also has a front sloped portion 137, proximate to front end 36 of frame 30 and a rear sloped portion 136 proximate to back end 34 of frame 30. Both front sloped portion 137 and rear sloped portion 136 slope down towards back end 34 of frame 30. Thus, when right front rail 72 and left front rail 74 are in position within their respective recesses 50, first pair of tabs 132 matingly engage second notches 92 and second pair of tabs 134 matingly engage third pair of notches 94 of right front rail 72 and left front rail 74.

Spreader block 140 has a right end 142 and a left end 144 that define a middle portion 146. In position, spreader block 140 is inserted within second groove 48 in base 44 of channel 40, so that spreader block 140 extends across channel 40. Therefore, right end 142 of spreader block 140 extends under right front recess 52, while left end 144 extends under left front recess 54. When right front rail 72 and left front rail 74 are in position in their respective recesses 50, right front rail 72 and left front rail 74 rest on top of right end 142 and left end 144 respectively. Therefore, middle portion 146 extends between right front rail 72 and left front rail 74, thus securing the lower portion of rails 72, 74 into the recesses 50.

Horseshoe 120, unlock block 130, and spreader block 140 cooperate together to securely hold right front rail 72 and left front rail 74 in position within their respective recesses 50. While the preferred embodiment of the present invention utilizes three separate pieces to secure the front pair of rails into position, those of ordinary skill in the art will recognize that changes and modifications can be made without departing from the spirit and scope of the present invention. For example, a single insert could be placed between right front rail 72 and left front rail 74, thus forcing the two rails apart from each other and into their respective recesses.

Additionally, horseshoe 120, unlock block 130, and spreader block 140 are positioned and located within frame 30 such that their presence does not interfere with any normal functions of handgun 10. Furthermore, sloped portions 136 and 137 of unlock block 130 actually aid in the operation of the drop barrel design of handgun 10.

As stated above, left rear rail 78 and right rear rail 76 have different shapes, with right rear rail 76 being shorter than left rear rail 78. Right rear rail 76 is insertable within right rear recess 56, and left rear rail 78 is insertable within left rear recess 58. Right rear rail 76 and left rear rail 78 are secured within their respective recesses 50 by sear block 18. Sear block's 18 function and operation is known to those of ordinary skill in the art, but serves the dual function of securing right rear rail 76 and left rear rail 78 within handgun 10. Additionally, right rear rail 76 and left rear rail 78 have a hole 104 that extends therethrough. Hole 104 is adapted to receive a pin 112 that extends through frame 30, sear block 18, left rear rail 78, and right rear rail 76, and across channel 40. Pin 112 provides a secure mount for sear block 18.

While it is possible to assemble the above parts to form handgun 10 at any time, in the preferred embodiment, the assembly process is performed while polymeric frame 30 is still warm. In other words, once polymeric frame 30 has been formed by the molding process, it is removed from the mold. Once removed, frame 30 is still warm and has not yet fully contracted to its final size. Consequently, recesses 50 within frame 30 and the distance across channel 40 are larger than normal. During this period, it is easier to insert spreader block 140 within second groove 48 and rails 70 within their respective recesses 50. Furthermore, it is easier to position the other metallic parts, including horseshoe 120 and unlock block 130, between front rails 52, 54, and sear block 18 between rear rails 56, 58. As polymeric frame 30 contracts to its final size, the metallic parts are securely held in position even tighter than if assembled after full contraction of polymeric frame 30.

The term "warm" as used herein is defined in terms of the thermal coefficient of expansion of a given polymeric compound. In other words, frame 30 should be cooled and contracted so that it is no longer malleable or flexible, but is rigid so that it will retain its shape. However, frame 30 should not have fully contracted to its final state. Those of ordinary skill in the art will be able to calculate the corresponding temperature ranges between "warm" and ambient temperatures for the specific polymeric compound being used.

It will be apparent to those skilled in the art that many changes and substitutions can be made to the preferred embodiment herein described without departing from the spirit and scope of the present invention as defined by the appended claims.

What is claimed is:

1. A handgun, comprising:

a frame having a channel formed therein, said channel having sides;

at least one pair of rails positioned within said channel of said frame; and at least one part positioned between each of said at least one pair of rails said at least one part engaging said at least one pair of rails and securing said at least one pair of rails against said sides of said channel.

2. The handgun as recited in claim 1, wherein said at least one part is a sear block.

3. The handgun as recited in claim 1, further comprising recesses formed within said sides of said channel, said at least one pair of rails positioned within said recesses of said channel.

4. The handgun as recited in claim 1, wherein said at least one pair of rails further comprise a left front rail, a left rear rail, a right front rail, and a right rear rail, and said sides of said channel having a left front recess, a left rear recess, a right front recess, and a right rear recess formed therein, each of said recesses formed to receive each of said at least one pair of rails.

5. The handgun as recited in claim 1, wherein said at least one part further comprises a horseshoe, an unlock block, and a spreader block.

6. The handgun as recited in claim 1, wherein said at least one pair of, rails and said at least one part are constructed from a metal, and said frame is constructed from a polymer.

7. The handgun as recited in claim 1, further comprising a slide having grooves formed therein, said at least one pair of rails having a tongue that slidably engages said grooves of said slide.

8. A handgun comprising:

a frame having a channel, said channel having sides with front recesses and rear recesses formed therein;

a pair of front rails positioned within said front recesses of said channel;

a pair of rear rails positioned within said rear recesses of said channel;

first means for securing said pair of front rails within said front recesses of said channel; and second means for securing said pair of rear rails within said rear recesses of said channel.

9. The handgun as recited in claim 8, wherein said second securing means comprises a sear block.

10. The handgun as recited in claim 8, wherein said pair of front rails have a plurality of notches formed therein, said first securing means matingly engaging said plurality of notches when said pair of front rails are positioned within said front recesses of said channel.

11. The handgun as recited in claim 8, wherein each of said pair of front rails has a first notch, said first securing means comprising a horseshoe having arms with a tab formed on each arm, said tabs engaging said first notch of said pair of front rails when said horseshoe is positioned therebetween.

12. The handgun as recited in claim 8, wherein said pair of front rails further comprises a right front rail and a left front rail; said right front rail having a first, second and third notch; said left front rail having a first, second, and third notch; and wherein said first securing means further comprises:

a horseshoe which matingly engages said first notch of said right front rail and said first notch of said left front rail when said horseshoe is positioned therebetween;

an unlock block which matingly engages said second and third notch of said right front rail and said second and third notch of said left front rail when said unlock block is positioned therebetween; and a spreader block which engages said right front rail and said left front rail when said spreader block is positioned therebetween.

13. The handgun as recited in claim 8, wherein said channel has a base with a first and second groove formed therein, said first securing means engaging said first and second groove when said pair of front rails and said first securing means are positioned within said channel of said frame.

14. The handgun as recited in claim 8, wherein said pair of front rails are removably positioned within said front recesses, and said pair of rear rails are removably positioned within said rear recesses.

15. A handgun comprising:

a frame having a channel, said channel having a base and sides, said base of said channel having a first groove and a second groove formed therein, said sides of said channel having a right front recess, a left front recess, a right rear recess, and a left rear recess formed therein;

a right front rail positioned within said right front recess of said channel;

a left front right rail positioned within said left front recess of said channel;

a right rear rail positioned within said right rear recess of said channel;

a left rear rail positioned within said left rear recess of said channel;

means for securing said right front rail within said right front recess and said left front rail within said left front recess; and a sear block positioned between said left rear rail and said right rear rail.

16. The handgun as recited in claim 15, wherein said right front rail has a first notch and said left front rail has a first notch; and wherein said securing means further comprises:

a horseshoe having a bottom end and a pair of arms, each of said arms having a tab formed thereon, said tabs engaging said first notch of said right front rail and said first notch of said left front rail, and said bottom end engaging said first groove within said base of said channel when said horseshoe is positioned within said channel and between said right front rail and said left front rail.

17. The handgun as recited in claim 15, wherein said securing means further comprises a spreader block having a right end and a left end defining a middle portion, said spreader block being insertable within said second groove within said base of said channel, so that said right end extends under said right front recess and said left end extends under said left front recess, said middle portion positioned between and engaging said left front rail and said right front rail when said right front rail is positioned within said front right recess and said left front rail is positioned within said left front recess.

18. The handgun as recited in claim 15 wherein said right front rail has a second and a third notch and said left front rail has a second and a third notch, and wherein said securing means further comprises: an unlock block having a first pair of tabs, a second pair of tabs, a front slope and a rear slope, said unlock block positioned between said right front rail and said left front rail, when said left front rail is positioned within said front recess, and said left front rail is positioned within said left front recess, so that said first pair of tabs of said unlock block engage said second notches within said right front rail and said left front rail, said second pair of tabs of said unlock block engage said third notch of said right front rail and said left front rail, and said rear slope of said unlock block is oriented proximate to said sear block.

19. The handgun as recited in claim 15, wherein said right front rail has a first notch, a second notch, and a third notch, and said left front rail has a first notch, a second notch, and a third notch; and wherein said securing means further comprises:

a horseshoe having a bottom end and a pair of arms, each of said arms having a tab formed thereon, said tabs engaging said first notch of said right front rail and said first notch of said left front rail, and said bottom end engaging said first groove within said base of said channel when said horseshoe is positioned within said channel and between said right front rail and said left front rail;

a spreader block having a right end and a left end defining a middle portion, said spreader block being insertable within said second groove within said base of said channel, so that said right end extends under said right front recess and said left end extends under said left front recess, said middle portion positioned between and engaging said left front rail and said right front rail when said right front rail is positioned within said right front recess and said left front rail is positioned within said left front recess; and an unlock block having a first pair of tabs, a second pair of tabs, a front slope, and a rear slope, said unlock block positioned between said right front rail and said left front rail, when said left front rail is positioned within said front recess and said left front rail is positioned within said left front recess, so that said first pair of tabs of said unlock block engage said second notches within said right front rail and said left front rail, said second pair of tabs of said unlock block engage said third notch of said right front rail and said left front rail, and said rear slope of said unlock block is oriented proximate to said sear block.

20. The handgun as recited in claim 15, wherein said frame and said sear block are constructed from a polymer, and said right front rail, said left, front rail, said right rear rail, said left rear rail, and said securing means are constructed from a metal.

21. The method of assembling a handgun, said handgun having a frame with channels formed therein, said channel having sides and a base, said sides having front recesses and rear recesses formed therein, said handgun further comprising: a pair of front rails, a pair of rear rails, a sear block, first means for securing said front rails within said front recesses of said channel, and second means for securing said front rails within said front recesses of said channel, said method comprising the steps of:

forming said frame from a polymeric material;

installing said second means within said frame;

inserting said pair of front rails within said front recesses of said channel;

positioning said rear rails within said rear recesses of said channel;

placing said sear block between said pair of rear rails; and locating said first securing means between said pair of front rails.

22. The method as recited in claim 21, wherein said inserting step, said positioning step, said placing step, and said locating step are performed when said frame is warm.

23. The method as recited in claim 21, wherein said second securing means comprises a spreader block and said first securing means comprises a horseshoe and a unlock block; and wherein installing step further comprises the step of installing said spreader block within said frame, and wherein said locating step further comprises the steps of locating said horseshoe and said unlock block between said pair of front rails, so that said pair of front rails are securely located within said front recesses.

* * * * *